US007475696B2

(12) United States Patent
Vanderroest et al.

(10) Patent No.: US 7,475,696 B2
(45) Date of Patent: Jan. 13, 2009

(54) DISHWASHER HAVING VALVED THIRD-LEVEL SPRAYER

(75) Inventors: Chad T. Vanderroest, Watervliet, MI (US); Jay Landsiedel, Kewanee, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 631 days.

(21) Appl. No.: 11/026,739

(22) Filed: Dec. 30, 2004

(65) Prior Publication Data

US 2005/0133070 A1 Jun. 23, 2005

Related U.S. Application Data

(63) Continuation-in-part of application No. 10/463,263, filed on Jun. 17, 2003.

(51) Int. Cl.
*B08B 3/02* (2006.01)

(52) U.S. Cl. ..... 134/94.1; 134/95.3; 134/99.1

(58) Field of Classification Search ..... 134/94.1, 134/95.1, 95.3, 99.1, 103.1, 198
See application file for complete search history.

(56) References Cited

U.S. PATENT DOCUMENTS

| | | | |
|---|---|---|---|
| 1,598,352 | A | 8/1926 | Kehoe, Jr. et al. |
| 1,897,821 | A | 2/1933 | Poli |
| 2,407,533 | A | 9/1946 | Brock |
| 2,918,927 | A | 12/1959 | Clearman |
| 3,060,944 | A | 10/1962 | Brollo |
| 3,217,721 | A | 11/1965 | Hertel |
| 3,253,784 | A | 5/1966 | Long et al. |
| 3,586,011 | A | 6/1971 | Mazza |
| 3,648,931 | A | 3/1972 | Jacobs |
| 3,718,149 | A | 2/1973 | Mazza |
| 3,828,818 | A | 8/1974 | Hunt |
| 3,915,180 | A | 10/1975 | Jacobs |
| 4,094,702 | A | 6/1978 | Rabuffetti |

(Continued)

FOREIGN PATENT DOCUMENTS

| | | |
|---|---|---|
| DE | 3403359 | 8/1985 |

(Continued)

OTHER PUBLICATIONS

The documents listed hereinabove were cited in the European Search Report EP 05112573.0 dated Nov. 23, 2006 received in connection with a European Application corresponding to the above-referenced U.S. application.

(Continued)

*Primary Examiner*—Michael Barr
*Assistant Examiner*—Saeed T Chaudhry
(74) *Attorney, Agent, or Firm*—John Morrison; Michael D. Lafrenz

(57) ABSTRACT

A dishwasher has multiple wash zones which are each supplied by a wash liquid supply. An interior tub configured to provide an interior wash chamber for washing dishes is divisible into three wash zones supplied by first, second, and third wash liquid supplies. The third wash zone is supplied by a wash liquid supply that is controllable independently of the other two wash liquid supplies. The third wash liquid supply can be controlled to supply wash liquid to a detergent dispenser or a wall-mounted spray manifold, or shut off separately from the first and second wash liquid supplies.

17 Claims, 10 Drawing Sheets

U.S. PATENT DOCUMENTS

| | | | | |
|---|---|---|---|---|
| 4,279,384 | A | 7/1981 | Yamamoto | |
| 4,320,781 | A | 3/1982 | Bouvet et al. | |
| 5,131,419 | A * | 7/1992 | Roberts | 134/50 |
| 5,331,986 | A | 7/1994 | Lim et al. | |
| 5,494,062 | A | 2/1996 | Springer | |
| 5,849,101 | A | 12/1998 | Edwards et al. | |
| 6,003,529 | A | 12/1999 | Perry, Jr. | |
| 6,666,220 | B2 | 12/2003 | Spanyer et al. | |
| 6,869,029 | B2 | 3/2005 | Ochoa, Sr. et al. | 239/380 |
| 2003/0168087 | A1 | 9/2003 | Inui et al. | |
| 2004/0173249 | A1 * | 9/2004 | Assmann et al. | 134/94.1 |
| 2005/0022847 | A1 | 2/2005 | Nito et al. | |
| 2005/0224098 | A1 | 10/2005 | Fujii et al. | |

FOREIGN PATENT DOCUMENTS

| | | | |
|---|---|---|---|
| DE | 19544985 | | 6/1996 |
| DE | 10124645 | | 12/2001 |
| EP | 0291713 | A1 | 11/1988 |
| EP | 0517015 | A1 | 12/1992 |
| EP | 0755650 | A1 | 1/1997 |
| EP | 0786230 | A2 | 7/1997 |
| EP | 1252856 | | 10/2002 |
| EP | 1488730 | A1 | 12/2004 |
| GB | 668181 | | 3/1952 |
| JP | 11076127 | | 3/1999 |
| KR | 20040006218 | | 1/2004 |
| WO | 00/22973 | A | 4/2000 |
| WO | WO-00/22973 | * | 4/2000 |
| WO | 2004058035 | A1 | 7/2004 |

OTHER PUBLICATIONS

The documents listed hereinabove were cited in the European Search Report EP 05112588.8 dated Nov. 22, 2006 received in connection with a European Application corresponding to the above-referenced U.S. application.

Bosch User Manual For Dishwasher, Pg. 22, Downloaded From Boschappliances.com On Feb. 15, 2005.

The Perfect Ten, 2005 American Building Product Awards, Home Magazine, Homemag.com, Published Feb. 2005.

Asko Unveils New Dishwasher, Appliance Magazine, Published May 8, 2003, Downloaded From Appliancemagazine.com Sep. 26, 2005.

Dishwashers, Power At A Price, Consumer Reports, p. 34, Published Mar. 2005.

Bosch Shu43 Built-In Dishwasher, Epinions.com, Published Jan. 26, 2001.

First Look, Power Washer, p. 92, Good Houskeeping Magazine, Published Sep. 2004.

* cited by examiner

DISHWASHER HAVING VALVED THIRD-LEVEL SPRAYER

CROSS-REFERENCE TO RELATED APPLICATION

This application is a continuation-in-part of U.S. application Ser. No. 10/463, 263, filed Jun. 17, 2003.

BACKGROUND OF THE INVENTION

1. Field of the Invention

The present invention relates to dishwashers, and more particularly to a dishwasher having multiple wash liquid supplies independently controlled through a valve.

2. Background

Modem dishwashers include a tub and an upper and lower rack or basket for supporting soiled dishes within the tub. A pump is provided for re-circulating wash liquid throughout the tub to remove soils from the dishes. Typically, larger dishes such as casserole dishes which have a propensity to be heavily soiled are carried on the lower rack and lighter soiled dishes such as cups and glasses are provided on an upper rack. The racks are generally configured to be moveable in or out of the tub for loading and unloading.

One of problems associated with the typical modern dishwasher is that the dishes receive somewhat uniform wash treatment no matter their positioning within a rack in the dishwasher. For example, in a typical dishwasher, a lower wash arm rotates about a vertical axis and is provided beneath the lower rack for cleaning the dishes on the lower rack and an upper wash arm is provided beneath the upper rack for cleaning the dishes on the upper rack. Dishes in the upper rack receive somewhat uniform wash treatment and dishes in the lower rack receive somewhat uniform wash treatment. Accordingly, lightly soiled dishes in either dish rack are subject to the same wash performance as the highly soiled dishes in the same wash rack, which can lead to poor wash performance of the highly soiled dishes. As a result, it would be advantageous to provide a dishwasher with a second or concentrated wash zone for washing larger dishes such as the casserole dishes, which are more likely to be heavily soiled.

Another problem associated with the modern dishwasher is that to achieve optimal wash performance of heavily soiled, larger dishes, the dishes may need to be loaded with the surface that needs to be washed face down. The face down approach allows the lower spray arm to reach the heavily soiled surface. Accordingly, it would be advantageous if the dishwasher could be provided with a second wash zone that allowed the heavily soiled dishes to be loaded in an upright position, thereby optimizing the number of dishes that can be loaded in the dishwasher on any given cycle. Finally, it would also be advantageous if the dishwasher allowed for a customized wash cycle option which optimized the use of the second wash zone.

Additionally, with variations in the size of the load, the type of dish being washed (e.g. dinner plates vs. cooking pans), and the placement of the dishes, modern dishwashers using a two or three-arm spray assembly may deliver wash liquid to empty dishwasher zones, may deliver inadequate wash liquid to loaded zones, and do not provide adequate control over delivery of wash liquid to specific zones or components for optimizing the cleaning of dishes. If the dishwasher is provided with an increased number of spray wash configurations, it is desirable to have multiple wash liquid valves that can be independently controlled to selectively deliver wash liquid to preselected zones or components.

SUMMARY OF THE INVENTION

An automatic dishwasher comprises a wash tub defining a wash chamber for receiving utensils to be washed and having an open face through which access is provided to the wash chamber, a door selectively moveable between open and closed positions for selectively closing the open face when the door is in the closed position, and a wash liquid delivery system comprising first, second, and third wash liquid supplies that supply wash liquid to the wash chamber wherein the delivery of wash liquid to the third wash liquid supply is selectively independent of the delivery of wash liquid to the first and second wash liquid supplies. The first and second wash liquid supplies can be fluidly interconnected. The wash liquid delivery system can further comprise a valve for selectively controlling the delivery of wash liquid to the third wash liquid supply.

The wash tub can be divisible into three wash zones with each of the first, second, and third wash liquid supplies supplying wash liquid to a different wash zone. The wash zones can be vertically demarcated. The third wash liquid supply can supply wash liquid to the uppermost wash zone.

The automatic dishwasher can further comprise upper and lower baskets for holding utensils, wherein the uppermost wash zone supplies wash liquid to an upper portion of the upper basket.

The third wash liquid supply can comprise a spray arm assembly for directing a spray of wash liquid into the wash chamber. The third wash liquid supply can further comprise an auxiliary spray arm assembly wherein the valve selectively controls the flow of wash liquid to the spray arm assembly and the auxiliary spray arm assembly. The spray arm assembly can be located near the top of the wash chamber, or near the front of the wash chamber.

The third wash liquid supply can further comprise an auxiliary wash aid dispenser wherein the valve selectively controls the flow of wash liquid to the spray arm assembly and the auxiliary wash aid dispenser. The auxiliary wash aid dispenser can be removable from the third wash liquid supply to permit the filling of the auxiliary wash aid dispenser, and can comprise a delivery tube that is fluidly connected to one of the first and second wash liquid supplies for dispensing the wash aid therefrom.

One of the first and second wash liquid supplies can comprise at least one wall-mounted spray manifold, and the delivery tube of the auxiliary wash aid dispenser is fluidly connected to the at least one spray manifold such that the wash liquid from the wash aid dispenser is dispensed through the spray manifold. Operation of the valve can shut off the third wash liquid supply from the first and second wash liquid supplies.

The first wash liquid supply can comprise a spray arm assembly located in a lower portion of the wash chamber, the second wash liquid supply can comprise a second spray arm assembly located in a middle portion of the wash chamber, and the third wash liquid supply can comprise a third spray arm assembly located in an upper portion of the wash chamber and wash liquid supply to the third spray arm assembly can be controlled selectively independent of the first and second spray arm assemblies.

DETAILED DESCRIPTION OF AN EMBODIMENT OF THE INVENTION

Figure 1:
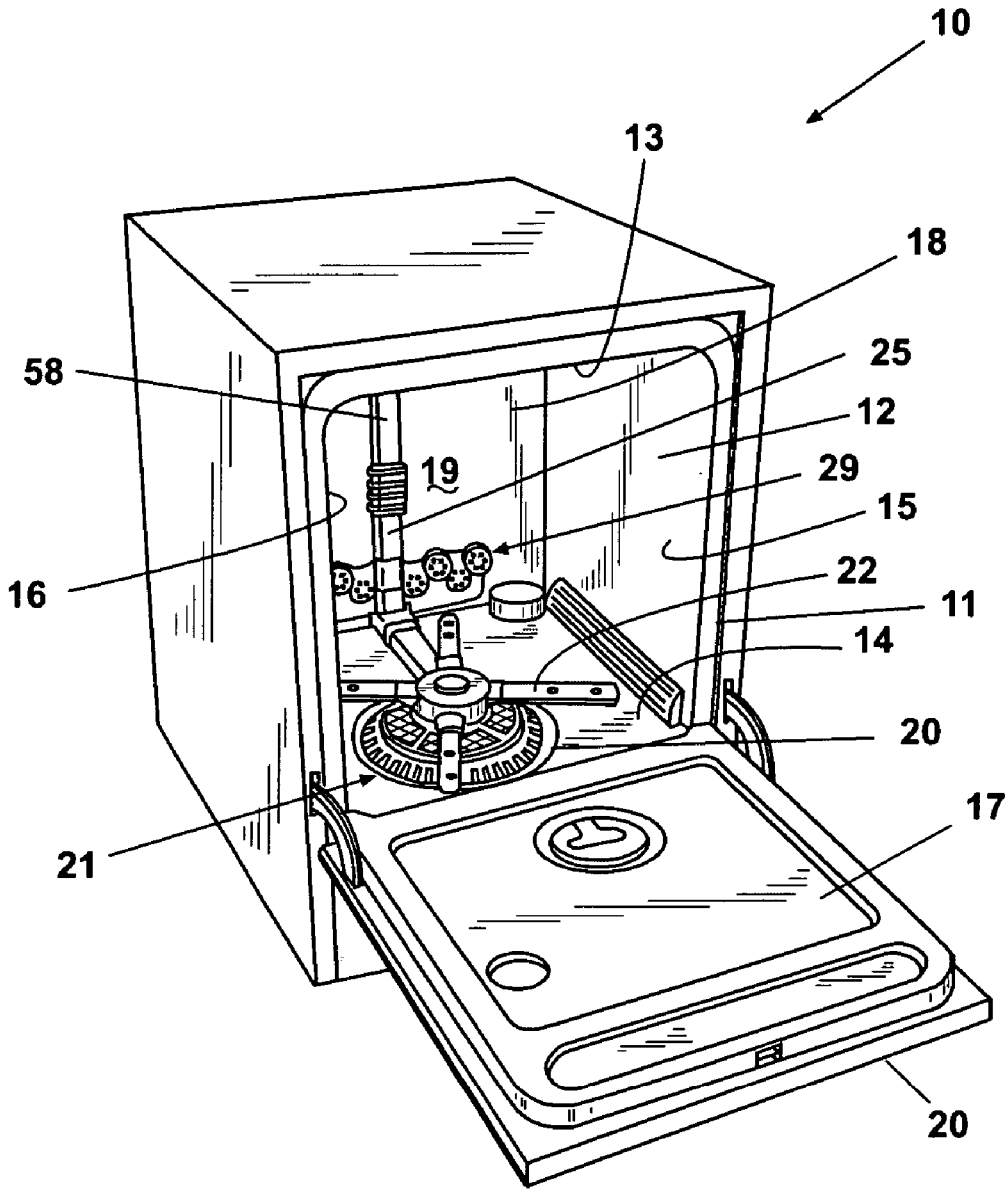
FIG. 1 is a perspective view of a dishwasher having an interior with multiple wash zones in accordance with the present invention.
Figure 2:
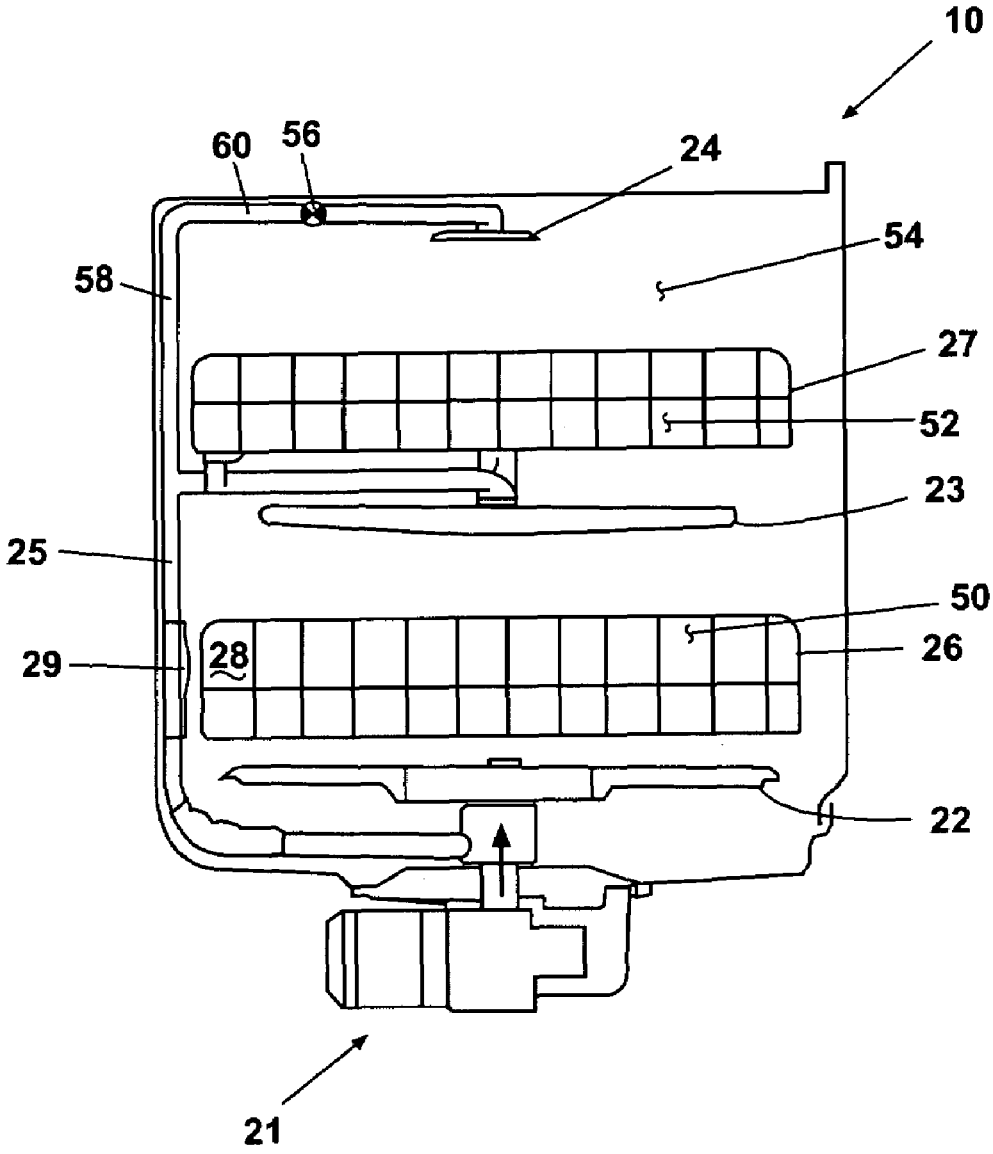
FIG. 2 is a schematic, cross-sectional view of the dishwasher shown in FIG. 1, showing the dish racks mounted in the tub, upper and lower spray arm assemblies, a spray manifold, and a third-level spray assembly having a control valve as contemplated by the present invention.

Referring now to the drawings, wherein like numerals indicate like elements throughout the views, FIGS. 1 and 2 illustrate an exemplary embodiment of a multiple wash zone dishwasher 10 in accordance with the present invention. In the embodiment shown generally in FIGS. 1 and 2, the dishwasher 10 comprises several elements found in a conventional dishwasher, including an interior tub 12 having a top wall 13, a bottom wall 14, two side walls 15, 16, a front wall 17, and a rear wall 18, which form an interior wash chamber or dishwashing space 19 for washing dishes. The front wall 17 can be replaced with an opening 11 which can be selectively closed with a door 20, which can be pivotally attached to the dishwasher 10 for providing accessibility to the dishwashing space 19 for loading and unloading dishes or other washable items. While the present invention is described in terms of a conventional dishwashing unit as illustrated in FIG. 1, it can also be implemented in other types of dishwashing units such as in-sink dishwashers or drawer dishwashers.

The bottom wall 14 of the dishwasher can be sloped to define a lower tub region or sump 20 of the tub 12. A pump assembly 21 can be located in or around a portion of the bottom wall 14 and in fluid communication with the sump 20 to draw wash liquid from the sump 20 and to pump the liquid to at least a lower spray arm assembly 22. If the dishwasher has a mid-level spray arm assembly 23 and/or an upper spray arm assembly 24, liquid can be selectively pumped through a fluidly-connected lower supply tube 25 and upper supply tube 58 to the assemblies 22-24 for selective washing.

As shown in FIG. 2, the lower supply tube 25 extends generally rearwardly from the pump assembly 21 to the rear wall 18 of the tub and upwardly to supply wash liquid to the mid-level spray arm assembly 23. The upper supply tube 58 extends generally upwardly from the lower supply tube 25 to supply wash liquid to the upper spray arm assembly 24. The upper spray arm assembly 24 is fluidly connected to the upper supply tube 58 through a top wall spray tube 60, which extends generally along and parallel to the top wall 13.

In the exemplary embodiment, the lower spray arm assembly 22 is positioned beneath a lower dish rack 26, the mid-level spray arm assembly 23 is positioned between an upper dish rack 27 and the lower dish rack 26, and the upper spray arm assembly 24 is positioned above the upper dish rack 27. As is typical in a conventional dishwasher, the lower spray arm assembly 22 is configured to rotate in the tub 12 and spray a flow of wash liquid in a generally upward direction over a portion of the interior of the tub 12. The spray from the lower spray arm assembly 22 is typically directed to providing a wash for dishes located in the lower dish rack 26. Like the lower spray arm assembly 22, the mid-level spray arm assembly 23 can also be configured to rotate in the dishwasher 10 and spray a flow of wash liquid in a generally upward direction over a portion of the interior of the tub 12. In this case, the spray from the mid-level spray arm assembly 23 is directed to dishes in the upper dish rack 27. Typically, the upper spray arm assembly 24 generally directs a spray of wash water in a generally downward direction and helps wash dishes on both dish racks 26, 27.

The spray of wash liquid from the lower spray arm assembly 22 defines a first "wash zone" 50 which, in the embodiment illustrated in FIG. 2, extends generally upwardly from the lower spray arm assembly 22 to a region extending somewhat above the lower dish rack 26. The spray of wash liquid from the mid-level spray arm assembly 23 defines a second "wash zone" 52 which, in the embodiment illustrated in FIG. 2, extends generally upwardly from the mid-level spray arm assembly 23 to a region generally coextensive with the upper dish rack 27. The spray of wash liquid from the upper spray arm assembly 24 defines a third "wash zone" 54 which, in the embodiment illustrated in FIG. 2, extends generally downwardly from the upper spray arm assembly 24 to a region generally coextensive with the upper dish rack 27.

In addition to one or more of the conventional spray arm wash assemblies described above, the present invention further comprises a fourth "wash zone", or more particularly, an intensified wash zone 28. While in the exemplary embodiment, the intensified wash zone 28 is located adjacent the lower dish rack 27 toward the rear of the tub 12, it could be located at virtually any location within the interior tub 12. The intensified wash zone 28 has been designed to enable heavily soiled dishes, such as casserole dishes, to receive the traditional spray arm wash, as well as an additional concentrated wash. Thus, a dishwasher having such a zone will not only provide better washing performance for heavily soiled dishware, but will provide overall improved wash performance.

Figure 3:
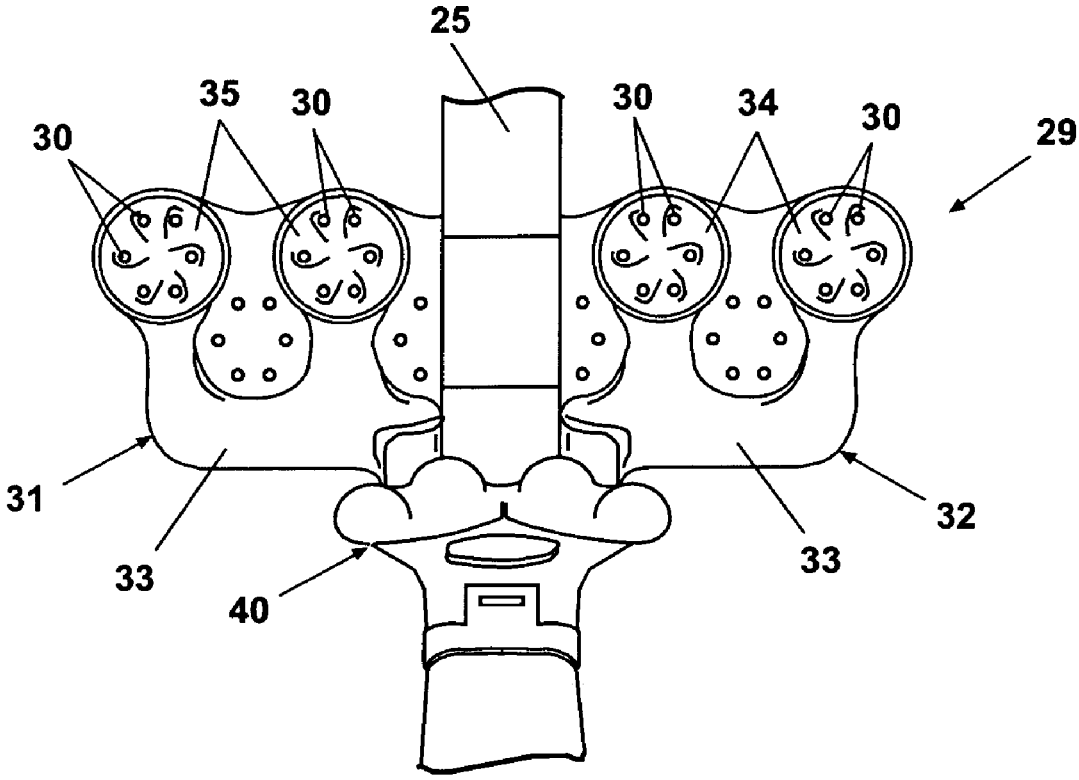
FIG. 3 is a front elevational view of a spray manifold in accordance with the exemplary embodiment of the present invention.

As illustrated in FIG. 3, the intensified wash zone 28 is achieved by selectively diverting wash liquid from the upper spray arm assemblies (23, 24) to a vertically oriented spray manifold 29 positioned on the rear wall 18 of the interior tub 12 adjacent the lower dish rack 26. In this way, a flow of wash liquid is directed toward the lower dish rack 26 from the manifold 29, thereby defining the intensified wash zone 28. As one of skill in the art should recognize, the spray manifold 29 is not limited to this configuration; rather, the spray manifold 29 can be located in virtually any part of the interior tub 12. For example, the manifold 29 could be moved up vertically along any portion of the wash liquid supply tube 25 such as to a position adjacent the upper dish rack 27. Alternatively, the manifold 29 can be positioned beneath the lower dish rack 26 adjacent or beneath the lower wash arm assembly 22. The illustrated configuration of the spray manifold 29 enables casserole dishes to be loaded in an upright position, to maximize or optimize the number of dishes that can be loaded in any given cycle.

In the exemplary embodiment, the spray manifold 29 is in fluid communication with the wash liquid supply tube 25 such that wash liquid can be selectively provided to the manifold 29. The manifold 29 is configured to have two symmetrically opposing halves (31, 32) positioned on opposite sides of the supply tube 25 with each half being configured to selectively receive wash liquid being pumped through the supply tube 25. Each half (31, 32) of the manifold 29 comprises a plurality of apertures 30 configured to spray wash liquid into the wash zone 28. Additionally, each half of the manifold 29 is configured with one or more passageways 33 to deliver wash liquid from the supply tube 25 to the apertures 30. As one of skill in the art will appreciate, the wash liquid being pumped through the supply tube 25 will be under pressure as it passes through passageway 33 and out apertures 30, thereby creating an intensified wash zone 28.

As illustrated in FIG. 3, each half (31, 32) of the spray manifold 29 comprises two substantially circular nozzles (34, 35) having a plurality of apertures 30 arranged in a substantially circular pattern. Each aperture 30 has a substantially oval shape and can selectively be oriented at a predefined angle with respect to the nozzle or with respect to the spray manifold 29. The spray manifold 29 can also extend across virtually any width of the interior wash tub 12, or can be limited to extending to only one side of the supply tube 25. Moreover, the number of nozzles (34, 35) can be selectively varied, as well as the height and positioning of each nozzle. Additionally, the shape, size, angle, arrangement. and number of apertures 30 in the manifold 29 can be varied to provide a more concentrated wash zone. For example, not only can the manifold 29 be configured to provide water flow to a particular zone, but the manifold can also be configured to provide a higher water flow.

Figure 4A:
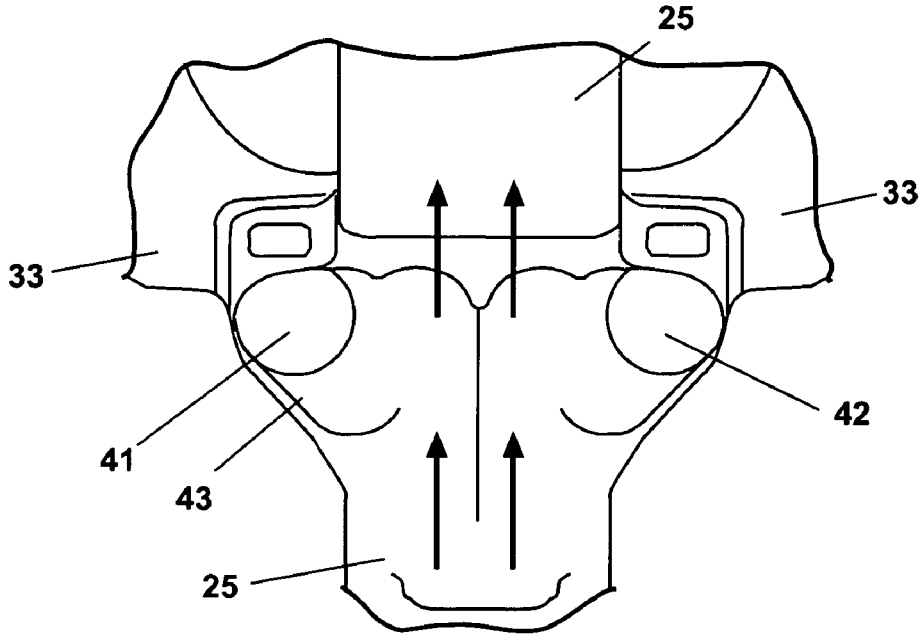
FIG. 4A is a schematic view of a first position of a valve for selectively diverting wash liquid to a supply tube in accordance with the exemplary embodiment of the present invention.
Figure 4B:
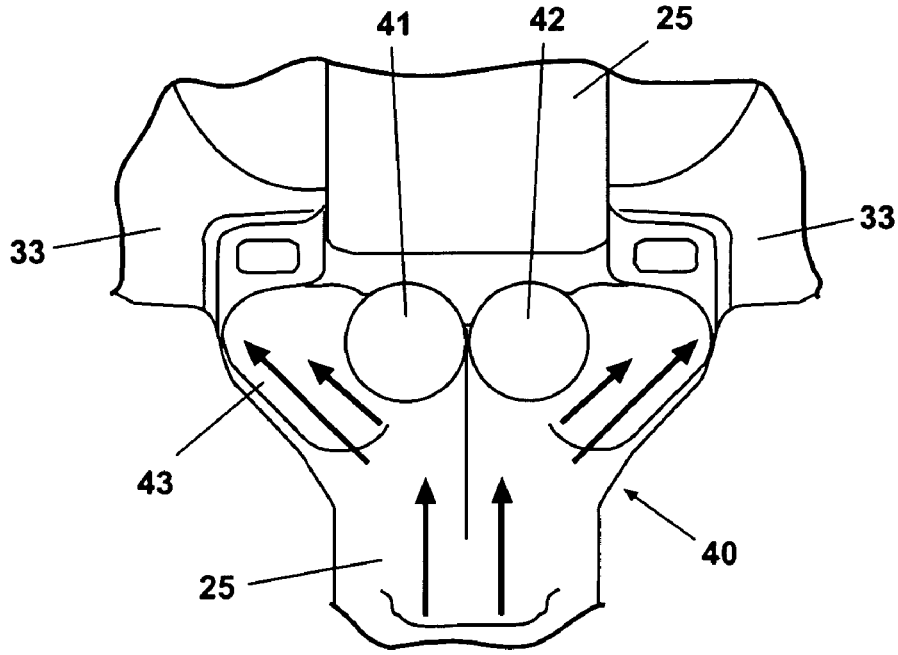
FIG. 4B is a schematic view of a second position of a valve for selectively diverting wash liquid to a spray manifold in accordance with the exemplary embodiment of the present invention.

As shown generally in FIG. 3 and more specifically in FIGS. 4*a* and 4*b*, a valve 40 can be provided to selectively divert wash liquid from the upper spray arm assemblies (23, 24) to the spray manifold 29. In the exemplary embodiment, the valve 40 is a magnetically actuatable diverter valve positioned in the supply tube 25 and is configured to direct the flow of wash liquid either through the supply tube 25 so it can reach the upper spray arm assemblies or through the spray manifold so it can reach the intensified wash zone 28. As one of skill in the art should appreciate, the valve could also be designed to selectively divert water from the lower spray arm.

In the exemplary embodiment, the valve 40 comprises a housing 43 and two diverter objects such as magnetic balls 41, 42 preferably having a ferrite core positioned within the housing and configured to be magnetically moved between a first position shown in FIG. 4*a* and a second position shown in FIG. 4*b*. In the first position, the diverter objects 41, 42 are magnetically positioned to substantially block passageway 33 associated with both halves 31, 32 of the spray manifold. In this way, wash liquid is prevented from entering the manifold and is pushed through the supply tube 25 toward the mid-level and upper spray arm assemblies. In the second position, the diverter objects 41, 42 are magnetically positioned to substantially block the supply tube 25, thereby allowing the wash liquid to enter both halves of the manifold through the passageway 33. While the exemplary embodiment illustrates a diverter valve using a plurality of magnetic objects, such as magnetic balls, to divert wash water between the upper spray arms and the manifold 29, one of skill in the art will recognize that an arrangement of flapper valves, wedges, or other known water diverter mechanisms can also be used.

Figure 5:
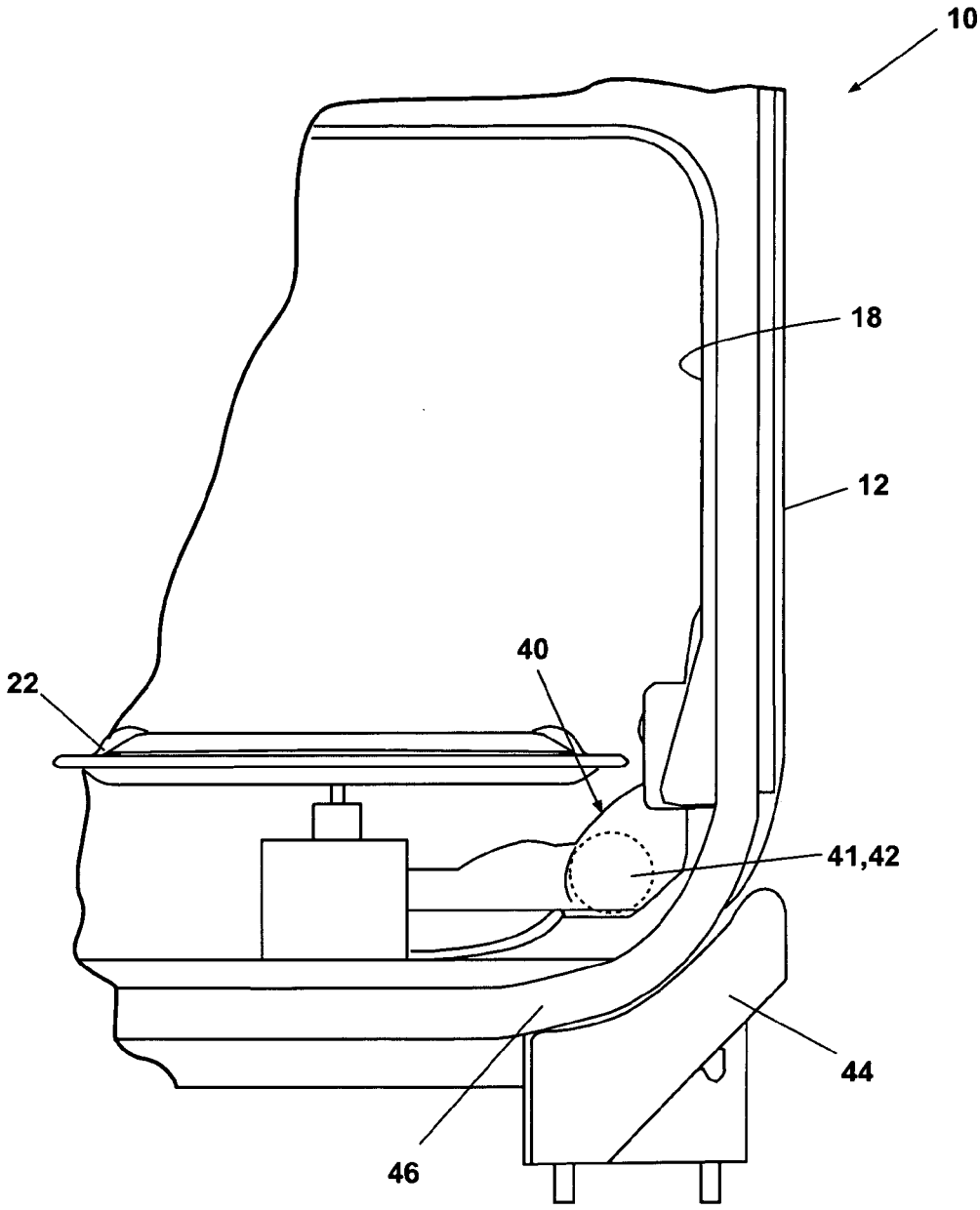
FIG. 5 is a schematic view of valve and actuator as contemplated by the present invention.

As shown in FIG. 5, an actuator 44 is positioned outside of the housing 43 and behind the tub 12 for magnetically moving the objects from the first position to the second position and vice versa. In the exemplary embodiment, the actuator 44 comprises a magnet with sufficient strength to magnetically manipulate the diverter objects (41, 42). It should be recognized that the magnet could be a permanent magnet, electromagnet or any other type magnet configured to move the diverter objects. The actuator 44 can be configured to be mounted to the outside 46 of the tub 12 in a variety of configurations and can be configured to be in communication with and controlled by the dishwasher's control panel (not shown) or the wash programs associated with the dishwasher 10. It should be recognized that to take advantage of the intensified wash zone, the dishwasher might be configured with customized wash cycle options that provide for zone actuation at optimal cycle intervals.

Figure 6:
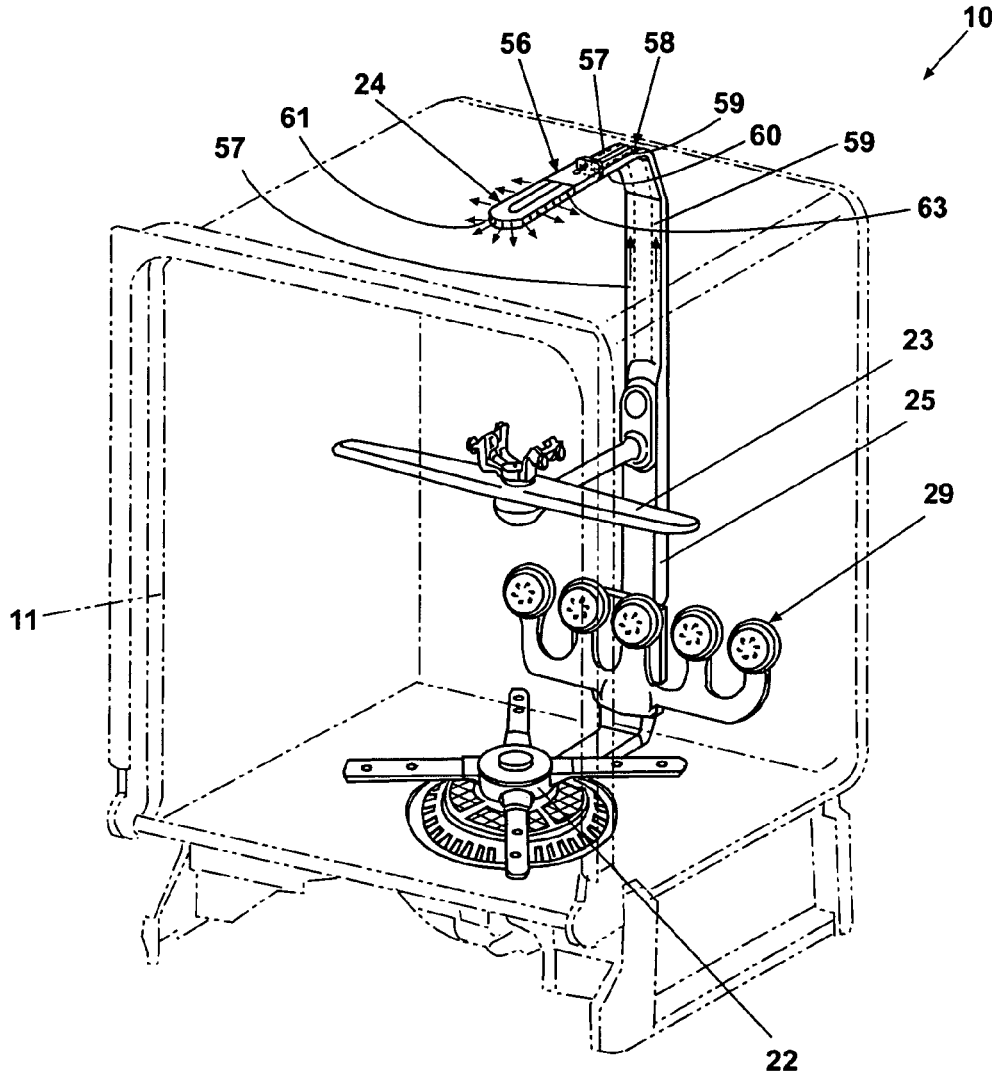
FIG. 6 is a perspective view of the interior components of the dishwasher illustrated in FIG. 1 including the third-level control valve.

Referring to FIG. 6, a second, independently-controllable valve 56 fluidly couples the top wall supply tube 60 to the upper spray arm 24 to control the flow of wash liquid in the top wall tube 60 to the upper spray arm 24. The valve 56 can be any suitable type of valve, including, for purposes of examples, a ball valve, configured and operated as previously described, or a suitable arrangement of flapper valves, wedges, or solenoid valves. The type of valve used is not important to the invention.

Figure 7A:
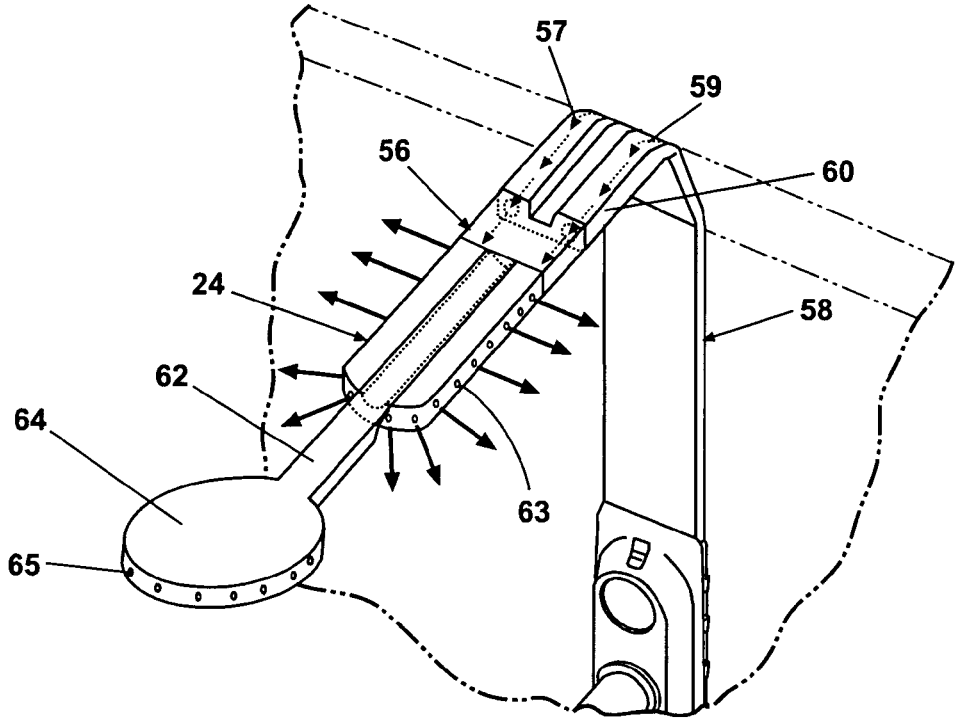
FIG. 7A is a schematic view of a second embodiment of the valve-controlled third-level spray assembly incorporating an auxiliary spray assembly, with the valve in a position for supply wash liquid to the third-level spray assembly.
Figure 7B:
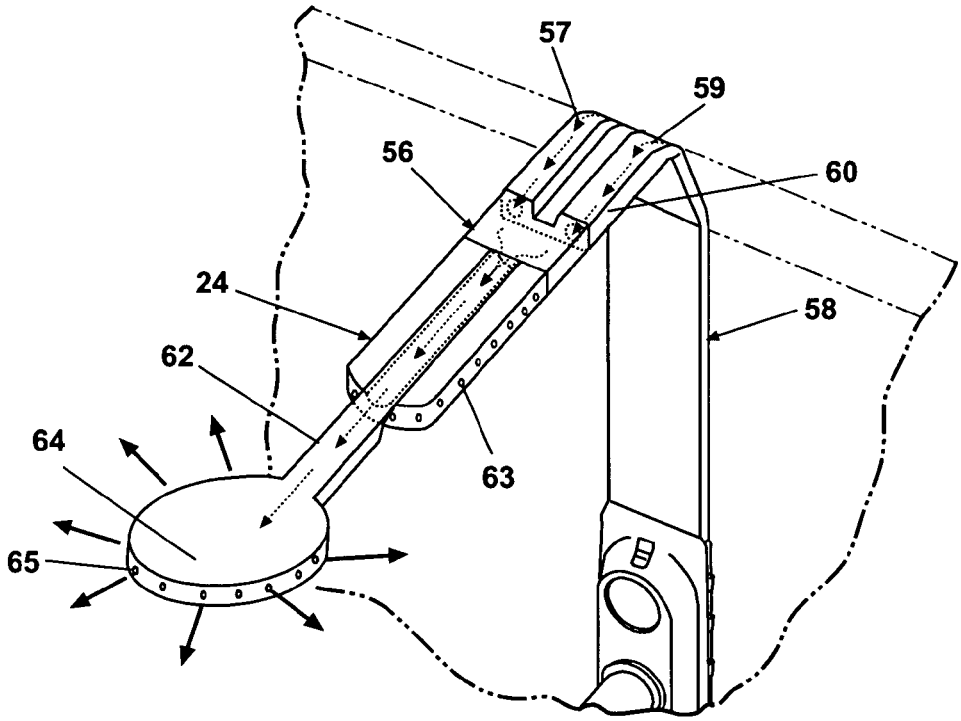
FIG. 7B is a schematic view identical to FIG. 7A except that the valve is in a position to supply wash liquid to the auxiliary spray assembly.
Figure 8:
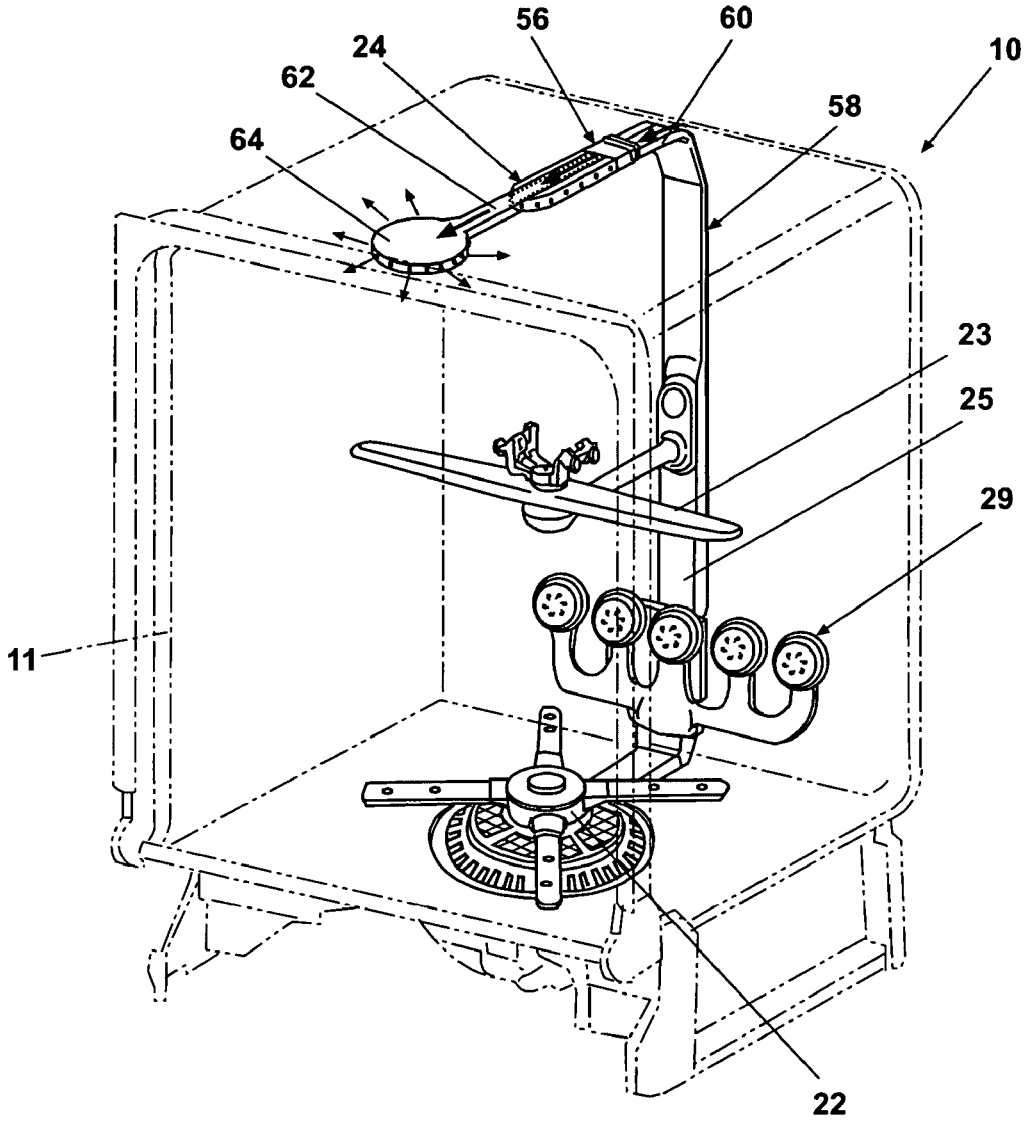
FIG. 8 is a perspective view of the second embodiment showing the auxiliary spray assembly located near the front of the wash chamber.

While the top wall supply tube 60 can have any suitable shape, as illustrated in FIGS. 6-8 it has a relatively thin cross section and is divided into two distinct fluid delivery tubes 57, 59, which supply opposing sets of spray openings 61, 63, respectively, in the upper spray arm assembly 24.

In the first embodiment illustrated in FIG. 6, the valve is operable between an opened and a closed condition. In the opened condition, wash liquid is free to flow from the top wall supply tube 60, to the upper spray arm assembly 24, and out the opposing sets of openings 61, 63. The operation of the valve 56 is preferably controlled by the dishwasher controller to enable the selective spraying of wash liquid through the upper spray arm assembly 24.

The interruption of flow to the upper spray arm assembly 24 by closure of the valve 56 will typically result in an increase in the pressure of the wash liquid flowing to the lower spray arm assembly 22 and the mid-level spray arm assembly 23.

FIGS. 7A and 7B illustrate a second embodiment of the valve-controlled upper spray arm that includes an auxiliary spray arm 64 connected to the valve 56 by an auxiliary delivery tube. The valve 56 operates between a first position, in which wash liquid flows to the upper spray arm assembly 24 (FIG. 7A), and a second position, where the wash liquid is diverted from the upper spray arm assembly 24 to the auxiliary delivery tube 62 to the auxiliary spray assembly 64 (FIG. 7B), located for illustrative purposes at the front of the wash chamber 19 adjacent the opening 11 (FIG. 8).

As illustrated in FIG. 8, this spray assembly 64 can be adapted for enhanced cleaning of heavily-soiled dishes placed adjacent to the door 20 in an upper rack. Alternatively, the spray assembly 64 can be located adjacent a silverware receptacle for enhanced cleaning of silverware (not shown), or adjacent a detergent or rinse aid dispenser for enhanced dispensing of detergent or rinsing agent (not shown). The spray assembly 64 can be adapted to direct a spray of wash liquid to a specific zone in the wash chamber 19 to enhance the performance of the dishwasher 10 relative to that zone.

Figure 9:
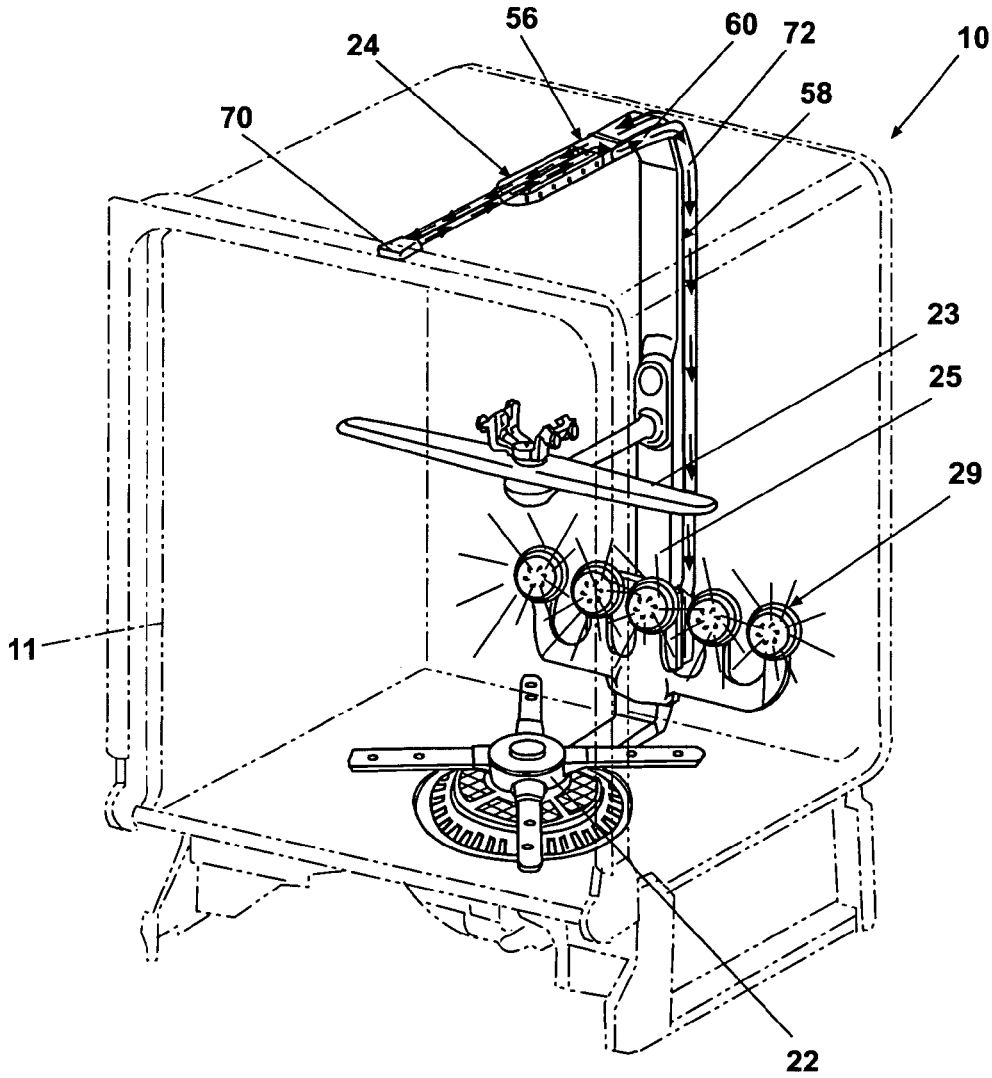
FIG. 9 is a perspective view of the interior components of the dishwasher with a third embodiment of the valve-controlled third-level spray assembly incorporating an auxiliary detergent dispenser for delivery to a spray manifold.
Figure 10:
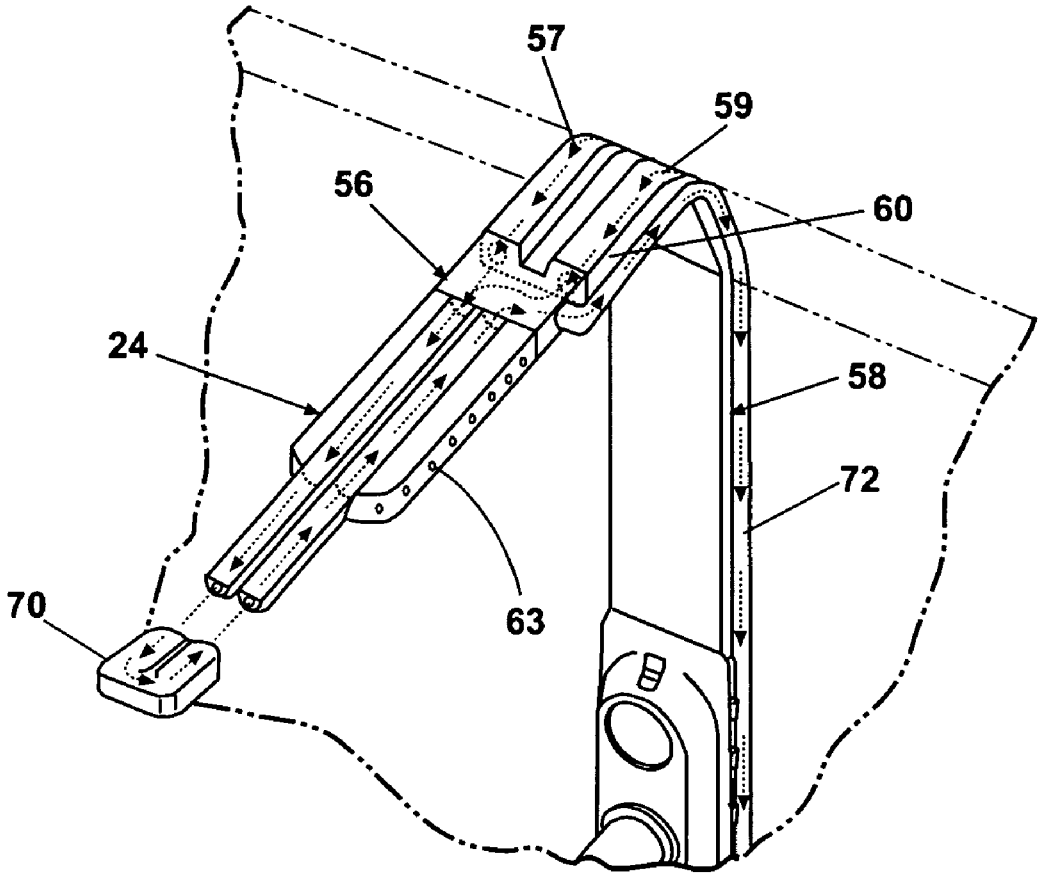
FIG. 10 is an enlarged view of the auxiliary detergent dispenser and a portion of its fluid connection to the spray manifold.

In a third embodiment, illustrated in FIGS. 9 and 10, the valve 56 fluidly couples the top wall supply tube 60 to either the upper spray arm assembly 24 and an auxiliary dispenser 70. This configuration can divert wash liquid from the upper spray arm assembly 24 to the auxiliary dispenser 70 which is designed to hold a supply of wash aid, such as detergent, for example. When the auxiliary dispenser 70 holds detergent the diversion of wash liquid through the auxiliary dispenser can provide an additional concentration of detergent during a preselected wash cycle for a specific zone in the wash chamber 19 or to increase the concentration of detergent in the wash liquid for heavily soiled utensils or during a selected wash cycle.

As illustrated, the valve 56 can be operated to deliver wash liquid to the dispenser 70. The wash liquid having an increased concentration of detergent can then be routed to a preselected location. For example, the valve 56 can divert wash liquid from the upper spray arm assembly 24 through an auxiliary wash liquid delivery tube 72 to the spray manifold 29, as illustrated in FIG. 9. The fluid output from the spray manifold 29 will form a wash zone of concentrated wash liquid. Alternatively, the auxiliary wash liquid delivery tube 72 could be coupled to any other general or specialized spray arm assembly or one or more spray manifolds can be positioned to direct a spray of wash liquid to any suitable wash zone.

The auxiliary dispenser 70 is located near the front of the wash chamber and removable mounted such that the user can easily access the auxiliary dispenser 70 for filling with a wash aid as needed. It is contemplated that the auxiliary dispenser 70 will be slidably mounted to the open ends of the top wall supply tube 60 and the auxiliary tube 72.

Depending upon the utilization of the diverted wash water, the valve 56 can be operated as a simple "on-off" valve, or a valve that is operated to provide wash water to the upper spray arm assembly 24 during a first preselected cycle and to an alternative location, such as the auxiliary detergent dispenser 70, during a second preselected cycle, resupplying wash water to the upper spray arm assembly 24 during a third preselected cycle, such as the rinse cycle.

The foregoing detailed description of the invention has been presented for purposes of illustration and description. It is not intended to be exhaustive nor limit the invention to the precise form disclosed. Many alternatives, modifications and variations have been discussed above, and others will be apparent to those skilled in the art in light of the above teaching.

We claim:

1. An automatic dishwasher comprising:

a wash tub defining a wash chamber for receiving utensils to be washed and having an open face through which access is provided to the wash chamber;

a door selectively moveable between open and closed positions for selectively closing the open face when the door is in the closed position; and a wash liquid delivery system comprising first, second, and third wash liquid supplies that supply wash liquid to the wash chamber, a spray arm assembly for directing a spray of wash liquid from the third wash liquid supply into the wash chamber, and an auxiliary spray arm assembly;

wherein the flow of wash liquid to the spray arm assembly and the auxiliary spray arm assembly can be selectively controlled independent of the delivery of wash liquid to the first and second wash liquid supplies.

2. An automatic dishwasher according to claim 1, wherein the first and second wash liquid supplies are fluidly interconnected.

3. An automatic dishwasher according to claim 1, wherein the wash liquid delivery system further comprises a valve for selectively controlling the delivery of wash liquid to the third wash liquid supply.

4. An automatic dishwasher according to claim 3, wherein the wash tub comprises three wash zones, each wash zone being associated with a wash liquid supply, with each of the first, second, and third wash liquid supplies supplying wash liquid to a different wash zone.

5. An automatic dishwasher according to claim 4, wherein the wash zones are vertically disposed.

6. An automatic dishwasher according to claim 5, wherein the third wash liquid supply supplies wash liquid to the uppermost wash zone.

7. An automatic dishwasher according to claim 3, and further comprising upper and lower baskets for holding utensils, wherein the uppermost wash zone supplies wash liquid to an upper portion of the upper basket.

8. An automatic dishwasher according to claim 3, wherein operation of the valve will shut off the third wash liquid supply from the first and second wash liquid supplies.

9. An automatic dishwasher according to claim 1, wherein the spray arm assembly is located near the top of the wash chamber.

10. An automatic dishwasher according to claim 1, wherein the auxiliary spray arm assembly is located near the front of the wash chamber.

11. An automatic dishwasher according to claim 1, wherein the first wash liquid supply comprises a spray arm assembly located in a lower portion of the wash chamber, the second wash liquid supply comprises a second spray arm assembly located in a middle portion of the wash chamber, and the third wash liquid supply comprises a third spray arm assembly located in an upper portion of the wash chamber and wash liquid supply to the third spray arm assembly is controlled selectively independent of the first and second spray arm assemblies.

12. An automatic dishwasher comprising:

a wash tub defining a wash chamber for receiving utensils to be washed and having an open face through which access is provided to the wash chamber;

a door selectively moveable between open and closed positions for selectively closing the open face when the door is in the closed position; and a wash liquid delivery system comprising first, second, and third wash liquid supplies that supply wash liquid to the wash chamber, a spray arm assembly for directing a spray of wash liquid from the third wash liquid supply into the wash chamber, and an auxiliary wash aid dispenser;

wherein the delivery of wash liquid to the spray arm assembly and the auxiliary wash aid dispenser can be selectively controlled independent of the delivery of wash liquid to the first and second wash liquid supplies.

13. An automatic dishwasher according to claim 12, wherein the auxiliary wash aid dispenser is removable from the third wash liquid supply to permit the filling of the auxiliary wash aid dispenser.

14. An automatic dishwasher according to claim 12, wherein the auxiliary wash aid dispenser comprises a delivery tube that is fluidly connected to one of the first and second wash liquid supplies for dispensing the wash aid therefrom.

15. An automatic dishwasher according to claim 14, wherein one of the first and second wash liquid supplies comprises at least one wall-mounted spray manifold and the delivery tube of the auxiliary wash aid dispenser is fluidly connected to the at least one spray manifold such that the wash liquid from the wash aid dispenser is dispensed through the spray manifold.

16. An automatic dishwasher according to claim 12, wherein the wash liquid delivery system further comprises a valve for selectively controlling the delivery of wash liquid to the third wash liquid supply.

17. An automatic dishwasher according to claim 12, wherein the valve can be operated to deliver wash liquid from the auxiliary wash aid dispenser to one of the first and second wash liquid supplies.

* * * * *